US007096703B2

(12) United States Patent
Kieffer

(10) Patent No.: US 7,096,703 B2
(45) Date of Patent: Aug. 29, 2006

(54) METHOD FOR MAKING A THREE-DIMENSIONAL METAL STRUCTURE

(76) Inventor: Joseph Kieffer, 72 rue de Silly, F-92100 Boulogne Billancourt (FR)

( * ) Notice: Subject to any disclaimer, the term of this patent is extended or adjusted under 35 U.S.C. 154(b) by 143 days.

(21) Appl. No.: 10/499,953

(22) PCT Filed: Dec. 20, 2002

(86) PCT No.: PCT/FR02/04493

§ 371 (c)(1),
(2), (4) Date: Jun. 21, 2004

(87) PCT Pub. No.: WO03/053608

PCT Pub. Date: Jul. 3, 2003

(65) Prior Publication Data

US 2005/0102942 A1 May 19, 2005

(30) Foreign Application Priority Data

Dec. 21, 2001 (FR) ..... 01 16683

(51) Int. Cl.
*B21D 13/08* (2006.01)
*B21D 13/10* (2006.01)

(52) U.S. Cl. ..... 72/186; 29/6.2

(58) Field of Classification Search ..... 29/6.1, 29/6.2, 897.31; 72/186, 187, 185, 324, 379.2
See application file for complete search history.

(56) References Cited

U.S. PATENT DOCUMENTS 1,090,843 A * 3/1914 Golding ..... 29/6.2
2,434,232 A 1/1948 Singleton
3,111,204 A * 11/1963 Phare ..... 52/635
3,869,778 A 3/1975 Yancey
4,170,122 A 10/1979 Cowell
6,032,503 A 3/2000 Grippe

FOREIGN PATENT DOCUMENTS

GB 240561 10/1925

* cited by examiner

*Primary Examiner*—Derris H. Banks
*Assistant Examiner*—Debra M Wolfe
(74) *Attorney, Agent, or Firm*—Lucas & Mercanti, LLP

(57) ABSTRACT

The invention provides a method of making a three-dimensional metal structure, the method being characterized by the following steps:

making longitudinal cuts in a sheet metal strip by causing the strip to pass between two rollers carrying annular knives whose blades are discontinuous and angularly offset from one roller to the other so as to form parallel rectilinear chords that are interconnected at regular intervals by connecting bridges and by linking legs, two adjacent chords being provided either with U-shaped bridges for connection with two legs of the same orientation, or with S-shaped bridges for connection with two legs of opposite orientations, and the U-shaped bridges are oriented in opposite directions from one chord to the next;

slicing the strip transversely by sectioning said chords and said bridges at different longitudinal positions;

moving every other precut chord into an offset plane by exerting vertical thrust on the chords carrying the U-shaped bridges so as to cause the legs to pivot and to bring the ends of said chords into vertical alignment with the S-shaped bridges; and stretching the strip in a transverse direction.

10 Claims, 5 Drawing Sheets

METHOD FOR MAKING A THREE-DIMENSIONAL METAL STRUCTURE

BACKGROUND OF THE INVENTION

The present invention relates to a method of making a three-dimensional metal structure.

Sheet structures already exist that are made from round section metal wires welded to form a trellis in various configurations. Nevertheless, those structures present low breaking strength under stress due to the local modification to the nature of the metal at the welds. In addition, those structures are too heavy per unit area of contact with the filler material, in particular for certain applications where the weight of the structure is penalizing. Furthermore, they are very rigid and present only two dimensions. When two sheets are assembled together in parallel by welded spacers so as to make a three-dimensional structure, they become bulky to store and therefore lead to unacceptable transportation costs. Furthermore, they present the drawback of being high in price since their methods of manufacture require assembly and welding operations that are lengthy and complex. In addition, the large number of weld zones increases the risk of embrittlement and makes quality control operations relatively laborious.

An object of the present invention is to remedy those technical problems in satisfactory manner.

BRIEF SUMMARY OF THE INVENTION

According to the invention, that object is achieved by means of a method of making a three-dimensional metal structure, characterized by the following steps:

making longitudinal cuts in a sheet metal strip by causing the strip to pass between two rollers carrying annular knives whose blades are discontinuous and angularly offset from one roller to the other so as to form parallel rectilinear chords that are interconnected at regular intervals by connecting bridges and by linking legs, two adjacent chords being provided either with U-shaped bridges for connection with two legs of the same orientation, or with S-shaped bridges for connection with two legs of opposite orientations, and the U-shaped bridges are oriented in opposite directions from one chord to the next;

slicing the strip transversely by sectioning said chords and said bridges at different longitudinal positions;

moving every other precut chord into an offset plane by exerting vertical thrust on the chords carrying the U-shaped bridges so as to cause the legs to pivot and to bring the ends of said chords into vertical alignment with the S-shaped bridges; and stretching the strip in a transverse direction.

In an advantageous variant, said longitudinal cuts are made by at least one unit series of eight adjacent knives whose respective peripheral blades co-operate with the blades of the adjacent knives to define empty zones enabling the bridges to be made.

In another variant, the knives are provided with blades whose longitudinal ends form pointed end edges.

According to an advantageous characteristic, the end edges of said blades are protected laterally by means of plane reinforcing walls carried by the immediately adjacent blades.

Preferably, said plane walls are backed by respective sloping transverse faces.

According to another characteristic, said blades around a single knife define intervening gaps between one another, the gaps being of profile complementary to the profile of said blades.

According to yet another characteristic, U-shaped bridges are formed for connection with two legs of the same orientation, and S-shaped bridges are formed for connection with two legs of opposite orientations.

In yet another variant, the longitudinal positions of the transverse sectioning of the chords are situated in alternation on either side of the line of cut through the bridges, and at a distance therefrom corresponding to the height of the offset plane.

In a specific variant, only the S-shaped bridges are sliced transversely.

In yet another variant, the lateral edges of the bridges are oblique.

In another implementation, the annular knives are made directly by machining the cylindrical faces of the rollers.

The method of the invention is constituted by simple steps that are particularly well adapted to being automated industrially without making use of welding and thus without transforming the mechanical properties of the metal.

In addition, the method uses as its sole starting material a strip of sheet metal which is subsequently machined by cutting and stretching tools without loss of metal and that are simple, quick, and therefore inexpensive to implement.

Finally, the absence of welds makes it possible to lighten the structure while retaining a large effective contact area between the metal and the filler or coating material. In addition, risks of breakage are reduced, thereby improving the reliability of works incorporating said structure.

BRIEF DESCRIPTION OF THE DRAWINGS

The present invention will be better understood on reading the following description given with reference to the accompanying drawings, in which.

DETAILED DESCRIPTION OF THE INVENTION

Figure 1A:
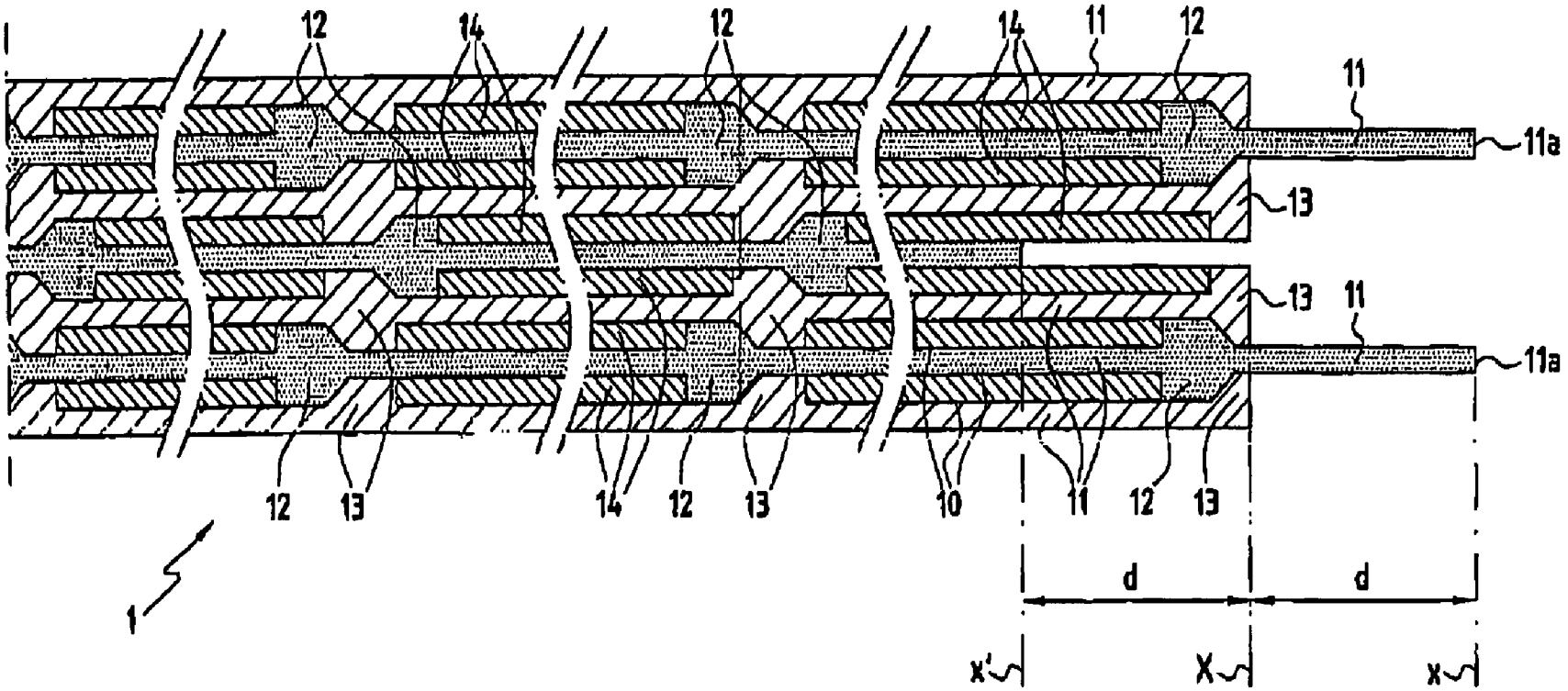
FIGS. 1A and 1B are a plan view and a perspective view of an embodiment of a structure made in accordance with the method of the invention and shown respectively while flat after the cutting and slicing steps, and in three dimensions during unfolding.
Figure 2A:
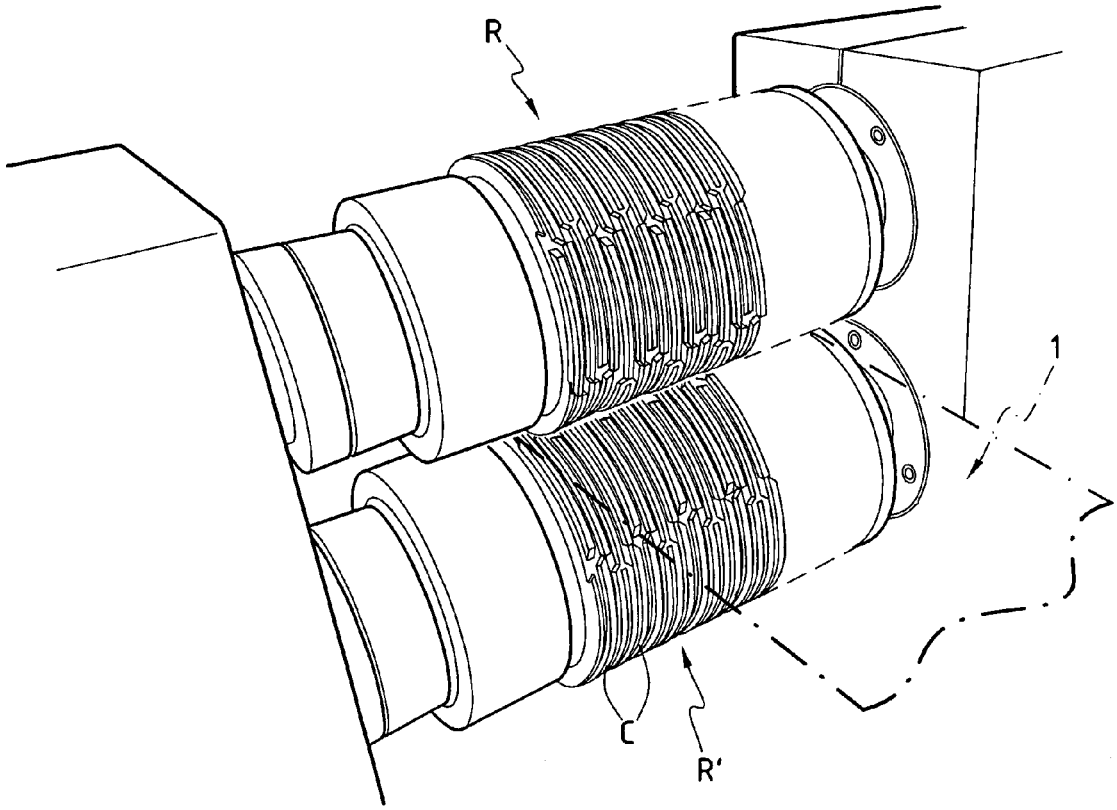
FIG. 2A is a diagrammatic perspective view of cutting rollers carrying the annular knives used in the method of the invention.

The structure shown in FIG. 1A is a strip of sheet metal 1 presenting longitudinal cuts 10 made by passing the strip horizontally between two rollers R, R' as shown in FIG. 2A, the rollers carrying knives C on their peripheries. The knives C are constituted by annular ribs N shown in FIGS. 2C to 2E with side edges forming discontinuous blades and offset angularly between the roller R and the roller R'. Thus, at any time, the rib of the top roller R which comes into bearing contact against the strip 1 is in register with a gap V of complementary profile and shape carried by a knife of the lower roller R'. The rib N can thus penetrate into the associated gap V, flattening the strip 1 and cutting it like a punch, without losing metal, by means of its blade-forming sharp edges. Between one another in pairs, the cuts 10 define parallel rectilinear chords 11 and legs 14 that project a little from the general plane of the strip 1. Along a line extending across the machined strip, there can thus be found in succession chords 11 and intervening legs 14. In this case, the chords 11 and the legs 14 are of substantially the same width.

The end zones 11*a* of the chords 11 slope because of the difference in level relative to the intervening legs 14. The chords 11 are interconnected at regular intervals by parallel linking legs and by connecting bridges 12, 13. The shapes, and in particular the angular orientations, of the bridges result from the profiles selected for the longitudinal edges of the blades of the knives C (see FIG. 2B). The side edges of the bridges are preferably oblique, thus giving them an orientation in one longitudinal direction or in the other. The linking legs 14 are of a length that is determined by the angular distance between two adjacent ribs N along the same knife C.

The bridges comprise U-shaped bridges 12 making connections with two same-orientation legs 14, and S-shaped bridges 13 for making connections with two oppositely-oriented legs 14.

The U-shaped bridges 12 are oriented in opposite directions from one chord to the next.

Once the longitudinal cuts have been made, the subsequent step consists in cutting and slicing the strip 1 transversely, sectioning the chords 11 and the bridges, but at different positions lengthwise.

Initially, the transverse sectioning applies only to the S-shaped bridges 13 substantially along a middle line.

The longitudinal positions x,x' of the transverse sectioning 11*b* of the chords 11 are situated in alternation on either side of the position X where the bridges 13 are cut and at a predetermined distance d therefrom depending on the thickness or height that is desired for the final three-dimensional structure.

Figure 1B:
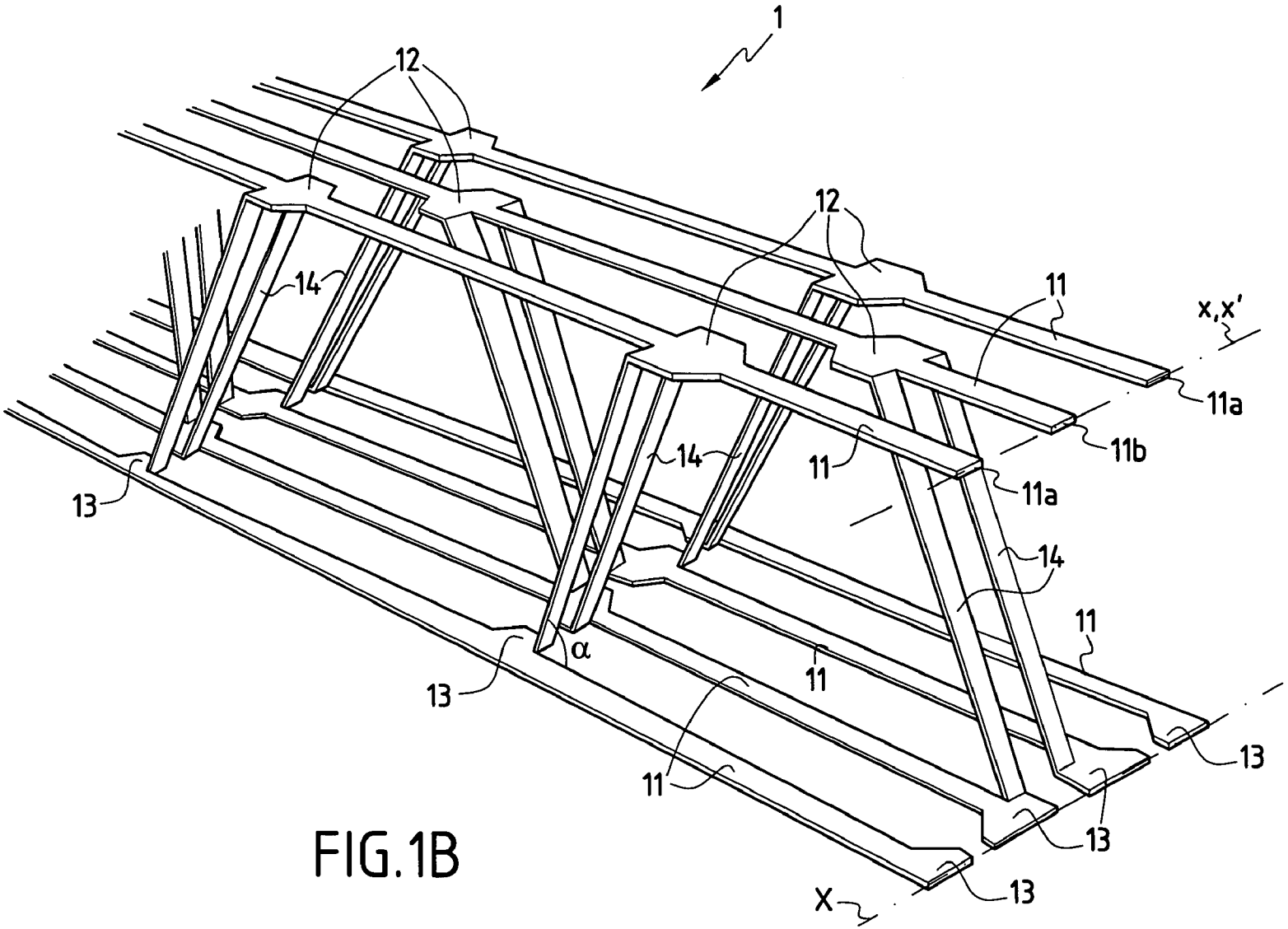

The strip segments are then subjected locally to vertical thrust forces exerted on the chords carrying the U-shaped bridges 12, i.e. against every other precut chord so as to constitute two offset planes of chords interconnected by legs 14, as shown in FIG. 1B. The orientation of the U-shaped bridges 12 determines the direction in which the chords that they carry will be moved, thus two successive chords with U-shaped bridges 12 will be moved in opposite directions. In general, each chord is moved in a direction opposite to the orientation of the bridges 12 carried by said chord. The final slope $\alpha$ of the legs relative to the offset planes of the chords 11 lies in the range 45° to 90°. This action is accompanied by upward pivoting of the legs, forming hinges, and enabling the chords to be moved until their sectioned ends 11*a* are in vertical alignment with the likewise sectioned S-shaped bridges 13.

The last step of the method consists finally in stretching the structure in a transverse direction so as to increase its width and orient the legs 14 in oblique directions, under guidance where appropriate of the S-shaped bridges 13.

This step can be implemented, for example, by exerting traction forces on at least one of the side edges of the strip.

The three-dimensional structure obtained in this way can subsequently be stacked in a nested configuration on other structures made by the method of the invention and already forming a stack.

FIG. 2A shows one of the two rollers R, R' used in the invention for cutting the strip of sheet metal longitudinally. The roller is constituted by a supporting core (not shown in the figures) having the annular knives C mounted coaxially thereabout. In a variant, the knives C are made directly on the cylindrical side faces of the rollers by machining. More precisely, in the method of the invention, the strip of sheet metal is cut by means of a unit series of eight annular knives C1–C8 disposed side by side and shown in developed view in FIG. 2B.

Along each knife, the ribs N provided with lateral blades define between one another firstly intermediate gaps V and secondly, from one knife to the next, empty spaces E providing communication between gaps for the purpose of making the bridges 12, 13. The empty zones E are obtained by angularly offset the ribs N around the knives. In the series, every other knife (C2, C4, C6, C8) is provided with ribs having blades whose longitudinal ends are chamfered so as to form pointed end edges a; these pointed edges are protected laterally from mechanical attack (FIG. 2D) by a plane reinforcing wall P carried by the rib of the immediately adjacent knife, and where appropriate backed by a sloping transverse face t as for the knives $C_1$ and $C_5$ (FIG. 2C).

On a given annular knife, the pointed end edges a are inverted in alternation from one end to the other of the rib N.

Figure 2B:
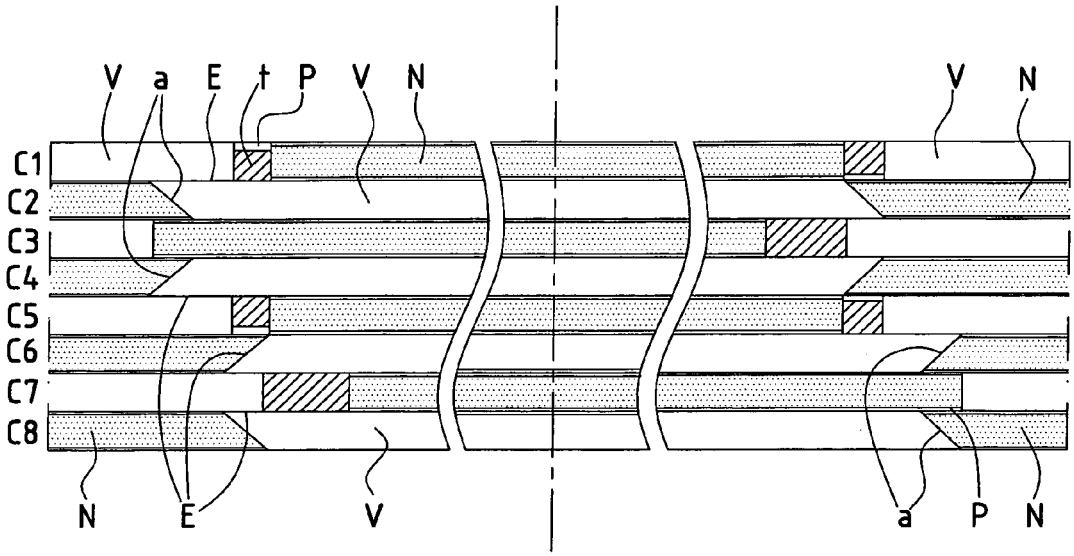
FIG. 2B is a fragmentary developed view of a series of knives.
Figure 2C:
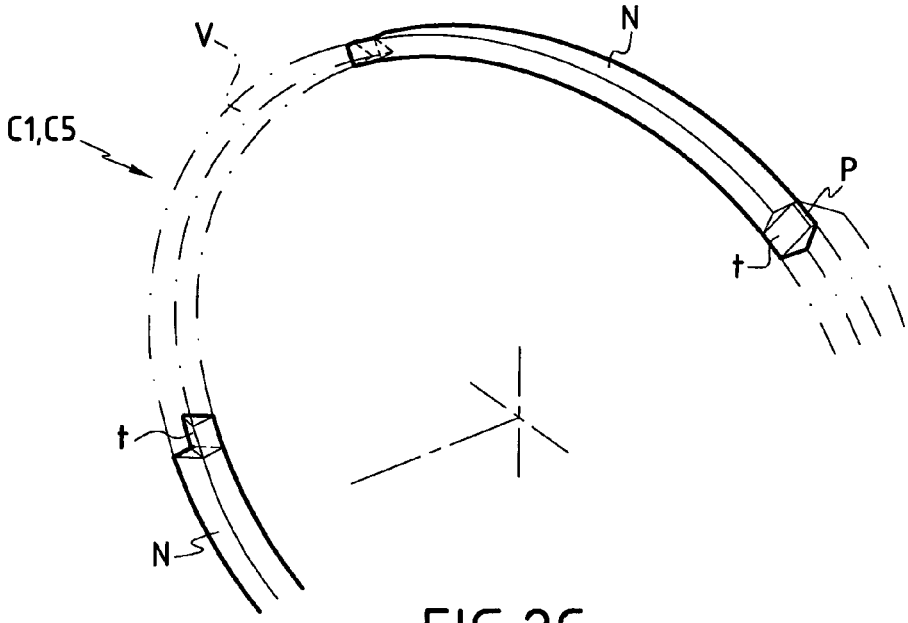
FIGS. 2C to 2E are perspective views of the main knives in the series.
Figure 2D:
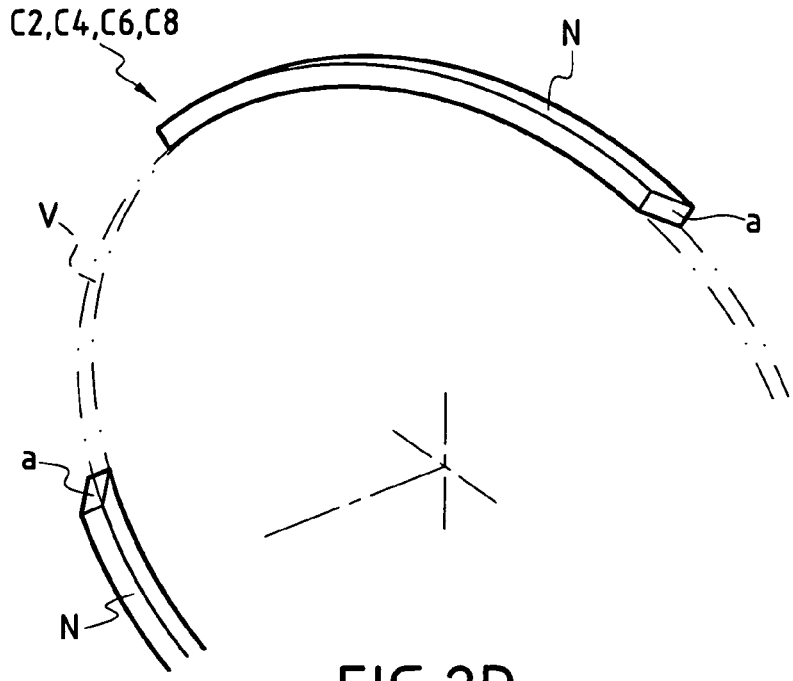

In the embodiment of FIG. 2B, between two knives having pointed end edges, there are knives $C_3$, $C_7$ whose ribs N present inclined faces F at their longitudinal ends.

Figure 2E:
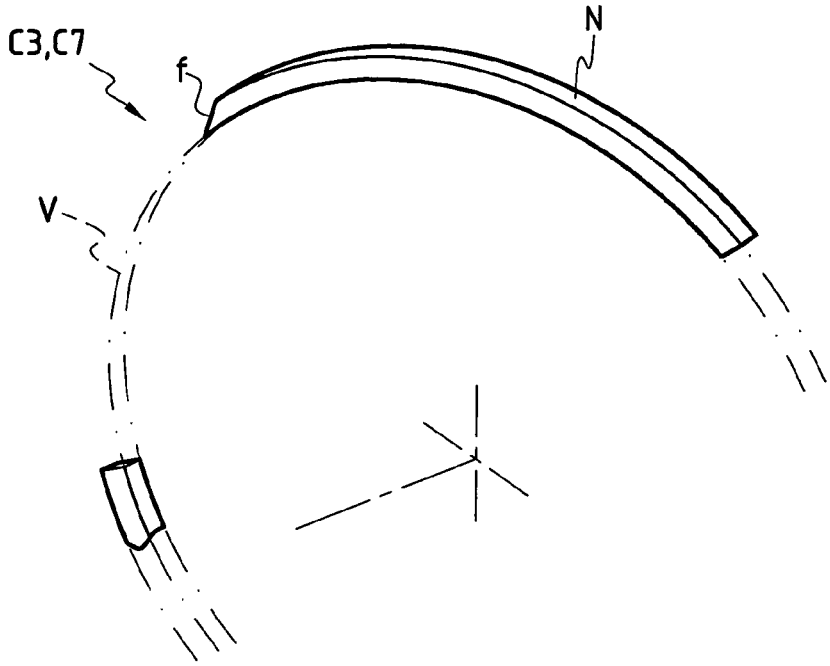

These faces F are disposed on the sides where the adjacent pointed end edges a diverge (see FIG. 2E).

The invention claimed is:

1. A method of making a three-dimensional metal structure, the method being characterized by the following steps:

making longitudinal cuts (10) in a sheet metal strip (1) by causing the strip to pass between two rollers (R, R') carrying annular knives (C) whose blades are discontinuous and angularly offset from one roller to the other so as to form parallel rectilinear chords (11) that are interconnected at regular intervals by connecting bridges (12, 13) and by linking legs (14), two adjacent chords being provided either with U-shaped bridges (12) for connection with two legs of the same orientation, or with S-shaped bridges (13) for connection with two legs of opposite orientations, and the U-shaped bridges are oriented in opposite directions from one chord to the next;

slicing the strip transversely by sectioning said chords (11) and said bridges at different longitudinal positions (X, x, x');

moving every other precut chord (11) into an offset plane by exerting vertical thrust on the chords carrying the U-shaped bridges (12) so as to cause the legs (14) to pivot and to bring the ends (11*a*) of said chords (11) into vertical alignment with the S-shaped bridges (13); and stretching the strip (1) in a transverse direction.

2. A method according to claim 1, characterized in that said longitudinal cuts are made by at least one unit series of eight adjacent knives ($C_1$–$C_8$) whose respective peripheral blades co-operate with the blades of the adjacent knives to define empty zones enabling the bridges (12, 13) to be made.

3. A method according to claim 2, characterized in that every other knife in said series is provided with blades whose longitudinal ends form pointed end edges (a).

4. A method according to claim 3, characterized in that the end edges (a) of said blades are protected laterally by means of plane reinforcing walls (P) carried by the immediately adjacent blades.

5. A method according to claim 4, characterized in that said plane walls (P) are backed by respective sloping transverse faces (t).

6. A method according to claim 1, characterized in that said blades around a single knife define intervening gaps (V) between one another, the gaps being of profile complementary to the profile of said blades.

7. A method according to claim 1, characterized in that the longitudinal positions (x, x') of the transverse sectioning of the chords (11) are situated in alternation on either side of the line of cut (X) through the bridges, and at a distance therefrom corresponding to the height of the offset plane.

8. A method according to claim 1, characterized in that only the S-shaped bridges (13) are sliced transversely.

9. A method according to claim 1, characterized in that the lateral edges of the bridges are oblique.

10. A method according to claim 1, characterized in that the annular knives are made directly by machining the cylindrical faces of the rollers.

* * * * *